US008991230B2

(12) United States Patent
Jeong et al.

(10) Patent No.: US 8,991,230 B2
(45) Date of Patent: Mar. 31, 2015

(54) ROLL FORMING METHOD AND SHAPED BEAM PRODUCED BY USING THE SAME

(75) Inventors: Kwang-Wook Jeong, Pusan (KR); Bong Kun Son, Busan (KR)

(73) Assignee: Sungwoo Hitech Co., Ltd., Pusan (KR)

( * ) Notice: Subject to any disclaimer, the term of this patent is extended or adjusted under 35 U.S.C. 154(b) by 321 days.

(21) Appl. No.: 13/325,454

(22) Filed: Dec. 14, 2011

(65) Prior Publication Data

US 2013/0136942 A1 May 30, 2013

(30) Foreign Application Priority Data

Nov. 29, 2011 (KR) ..... 10-2011-0126333

(51) Int. Cl.
*B21D 5/14* (2006.01)

(52) U.S. Cl.
USPC ..... 72/169; 72/168; 72/370.23

(58) Field of Classification Search
USPC ..... 72/52, 166, 168, 169, 177, 224, 225, 72/367.1, 368, 370.23, 370.26, 181, 234
See application file for complete search history.

(56) References Cited

U.S. PATENT DOCUMENTS

| | | | | |
|---|---|---|---|---|
| 514,026 | A | 2/1894 | Phelps | |
| RE26,308 | E * | 11/1967 | Cleland et al. | 72/181 |
| 3,736,846 | A * | 6/1973 | Frankenberg | 493/295 |
| 4,526,024 | A * | 7/1985 | Toti | 72/177 |
| 4,942,753 | A * | 7/1990 | Willeke | 72/178 |
| 5,104,026 | A * | 4/1992 | Sturrus et al. | 228/17.5 |
| 5,305,625 | A | 4/1994 | Heinz | |
| 5,306,058 | A | 4/1994 | Sturrus et al. | |
| 5,566,874 | A | 10/1996 | Sturrus | |
| 5,580,120 | A * | 12/1996 | Nees et al. | 296/146.6 |
| 6,102,472 | A * | 8/2000 | Wallstrom | 296/203.01 |
| 6,296,287 | B1 | 10/2001 | Kinbara et al. | |
| 6,349,521 | B1 * | 2/2002 | McKeon et al. | 293/102 |
| 6,360,441 | B1 * | 3/2002 | Himsl et al. | 29/897.2 |
| 8,333,096 | B2 * | 12/2012 | Heinz et al. | 72/168 |
| 8,419,091 | B2 * | 4/2013 | Roll et al. | 293/120 |
| 2002/0040525 | A1 | 4/2002 | Himsl et al. | |
| 2008/0093867 | A1 | 4/2008 | Glasgow et al. | |

FOREIGN PATENT DOCUMENTS

| | | | |
|---|---|---|---|
| CN | 101176964 | | 5/2008 |
| DE | 69100316 | T2 | 1/1994 |
| DE | 69914775 | T2 | 12/2004 |
| DE | 112007002534 | T5 | 12/2009 |
| JP | 2004-042124 | A | 2/2004 |
| JP | 2005-169447 | A | 6/2005 |
| KR | 100206022 | B1 | 7/1999 |
| KR | 10-2008-0101535 | A | 11/2008 |
| KR | 10-2009-0053080 | | 5/2009 |
| KR | 10-2011-0126333 | A | 11/2011 |

* cited by examiner

*Primary Examiner* — Edward Tolan
(74) *Attorney, Agent, or Firm* — Alston & Bird LLP

(57) ABSTRACT

A roll forming method including a roll forming step performed by a plurality of roll formers and a bending step performed by a round bender provided with a plurality of bending roll units is disclosed.

After a concave surface is formed at a surface of a shaped beam sequentially bent so as to have a closed section at the roll forming step, the concave surface is disposed so as to face toward an inward of a curvature of the shaped beam in the round bender and the shaped beam is formed to have the curvature through multiple steps at the bending step.

14 Claims, 9 Drawing Sheets

(ST1)

(ST4)

ROLL FORMING METHOD AND SHAPED BEAM PRODUCED BY USING THE SAME

CROSS-REFERENCE TO RELATED APPLICATION

This application claims priority to and the benefit of Korean Patent Application No. 10-2011-0126333 filed in the Korean Intellectual Property Office on Nov. 29, 2011, the entire contents of which are incorporated herein by reference.

BACKGROUND OF THE INVENTION (a) Field of the Invention

The present invention relates to a roll forming method and a shaped beam produced by using the same. More particularly, the present invention relates to a roll forming method and a shaped beam produced by using the same that prevents generation of non-uniform dents due to heel tap at an inward surface of a curvature when a shaped beam of a closed section produced through a roll forming process is formed to have the curvature.

(b) Description of the Related Art

Generally, a roll forming method is a method in which a coil is uncoiled and the uncoiled coil is bent to various shapes by passing through a roll forming unit. The roll former unit includes a plurality of roll formers that are sequentially disposed, and each roll former is provided with an upper forming roll and a lower forming roll. The roll forming method is used for manufacturing beams of linear type (particularly, a bumper beam for a vehicle) which is bent to the various shapes.

FIG. 1 is a schematic diagram of a typical roll forming system and steps of a roll forming method.

Referring to FIG. 1, the typical roll forming system and method thereof includes an uncoiler 1 at a front portion of a process line, and the uncoiler 1 performs an uncoil step S1 at which a coil 10 is uncoiled.

A straightener 2 is provided at the rear of the uncoiler 1 in the process line and performs a straightening step S2 at which the coil uncoiled from the uncoiler 1 is straightened to a panel 20 of plate shape.

A brake press 3 is disposed at the rear of the straightener 2 in the process line and performs a piercing step S3 at which a plurality of holes for assembling is formed at the panel 20 supplied from the straightener 2.

A roll forming unit 4 including at least seven roll formers R1-R7 is disposed at the rear of the brake press 3 in the process line. The roll forming unit 4 performs a roll forming step S4 at which the panel 20 passing through the uncoiler 1, the straightener 2, and the brake press 3 is sequentially bent such that a shaped beam 30 having a desired closed section is formed.

A laser welding device 5 is disposed at the rear of the roll forming unit 4 in the process line and performs a welding step S5 at which a laser beam outputting from a laser oscillator 5*a* is irradiated to a welding portion of the shaped beam 30.

In addition, a round bender 6 is provided at the rear of the laser welding device 5 in the process line and performs a bending step S6. At the bending step S6, the shaped beam 30 passes through a plurality of bending roll units disposed along a desired curvature such that the shaped beam 40 having the curvature is formed.

FIG. 2 is a side view of a typical round bender.

Referring to FIG. 2, the round bender 6 includes five bending roll units.

A first bending roll unit BR1 includes a pair of bending rolls and is disposed at a front portion of a roll frame 6*a* in the process line. The first bending roll unit BR1 guides the shaped beam 30 passing through the welding step S5.

A second bending roll unit BR2 includes a pair of bending rolls and is disposed at the rear of the first bending roll unit BR1 on the roll frame 6*a*. The second bending roll unit BR2 rolling-supports the shaped beam 30 along the curvature direction.

In addition, third, fourth, and fifth bending roll units BR3, BR4, and BR5 respectively include a pair of bending rolls, and are sequentially disposed at the rear of the second bending roll unit BR2 on the roll frame 6*a* along the curvature. The shaped beam 30 passes through the third, fourth, and fifth bending roll units BR3, BR4, and BR5 sequentially such that the shaped beam 40 having the curvature is formed.

A cutting press 7 is disposed at the rear of the round bender 6 in the process line and performs a cutting step S7 at which the shaped beam 40 is cut in a size of the finished product.

FIG. 3 is a perspective view of a shaped beam produced by a typical roll forming system and a method thereof.

Referring to FIG. 3, the shaped beam 50 produced by the typical roll forming system and the method thereof includes the closed sections at an upper portion and lower portion thereof, and is formed to have the curvature along a length direction thereof. In addition, widths of the upper closed section and the lower closed section are different.

The shaped beam 50 can be applied to components of a vehicle body or various industrial beam members, and particularly, to a bumper beam of a vehicle.

A plurality of non-uniform dents D due to heel tap can be generated at a surface of the lower closed section facing toward an inward of the curvature in the shaped beam 50 as shown in FIG. 3, when the shaped beam 50 is formed to have the curvature through the round bender 6. The dent may deteriorate impact strength of the shaped beam 50.

In a case that such a shaped beam 50 is applied to the bumper beam of the vehicle, a hole H is bored at one side of the shaped beam 50 and a towing hook pipe (not shown) is inserted in the hole H. At this state, the shaped beam 50 and the towing hook pipe are welded by using $CO_2$. At this time, the non-uniform dent D on the shaped beam 50 causes non-uniform surfaces between the towing hook pipe and a welding portion of the shaped beam 50, and bad welding may occur.

In order to secure welding quality of the shaped beam 50 and the towing hook pipe (not shown), all the welding portions should be inspected and additional welding should be performed at bad welding portions. However, theses may deteriorate productivity in automated processes.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a roll forming method and a shaped beam produced by using the same having advantages of preventing occurrence of non-uniform dents and improving strength of the shaped beam as a consequence that a concave surface is formed at a surface of a closed section facing toward an inward of a curvature so as to absorb heel tap when the shaped beam of a closed section is formed to have the curvature.

In one or more exemplary embodiments of the present invention, a roll forming method including a roll forming step performed by a plurality of roll formers and a bending step performed by a round bender provided with a plurality of bending roll units are disclosed.

After a concave surface is formed at a surface of a shaped beam sequentially bent so as to have a closed section at the roll forming step, the concave surface is disposed so as to face toward an inward of a curvature of the shaped beam in the round bender and the shaped beam is formed to have the curvature through multiple steps at the bending step.

Formation of the concave surface begins at the rearmost roll former of the plurality of roll formers.

Formation of the shaped beam to have the curvature is performed by at least three bending roll units provided in the round bender.

The shaped beam includes an outer side surface adjacent to the concave surface, and the outer side surface is slanted toward the concave surface so as to have a slanted angle.

the slanted angle of the outer side surface is controlled at the roll forming step but is not controlled at the bending step.

The concave surface is formed as a predetermined curvature.

According to another aspect of the present invention, the shaped beam produced by using the roll forming method is disclosed.

The shaped beam is formed so as to have at least one closed section, and the concave surface is formed at a surface of the closed section facing toward the inward of the curvature of the shaped beam.

According to other aspect of the present invention, it is disclosed that a roll forming method including a roll forming step where a shaped beam having at least one closed section is roll-formed by sequentially bending a panel through a roll forming unit provided with a plurality of roll formers, and a bending step where the shaped beam is formed so as to have a curvature through a round bender provided with a plurality of bending roll units.

The roll forming method includes: a first step where a concave surface is formed at a surface of the shaped beam facing toward an inward of the curvature will be formed; a second step where the concave surface is formed to have a maximum allowable depth; a third step where the concave surface is formed to have a depth shallower than the maximum allowable depth such that residual stress of a formed portion is absorbed and plastic deformation is led; and a fourth step where the concave surface of the shaped beam is disposed so as to face toward the inward of the curvature such that heel tap due to formation of the curvature is absorbed, and the shaped beam is formed to have the curvature through multiple steps.

The first step is performed by the rearmost roll former of the roll forming unit.

The second step to the fourth step are performed by bending roll units of the round bender.

The shaped beam includes an outer side surface adjacent to the concave surface, and the outer side surface is formed to have a respective predetermined slanted angle at each step.

The slanted angle of the outer side surface is respectively controlled at the first step, the second step, and the third step.

The slanted angle of the outer side surface is not controlled at the fourth step such that a stress due to heel tap toward the concave surface occurring at formation of the curvature of the shaped beam is absorbed.

The fourth step is performed through at least three bending roll units.

<Description of symbols>

Figure 1:
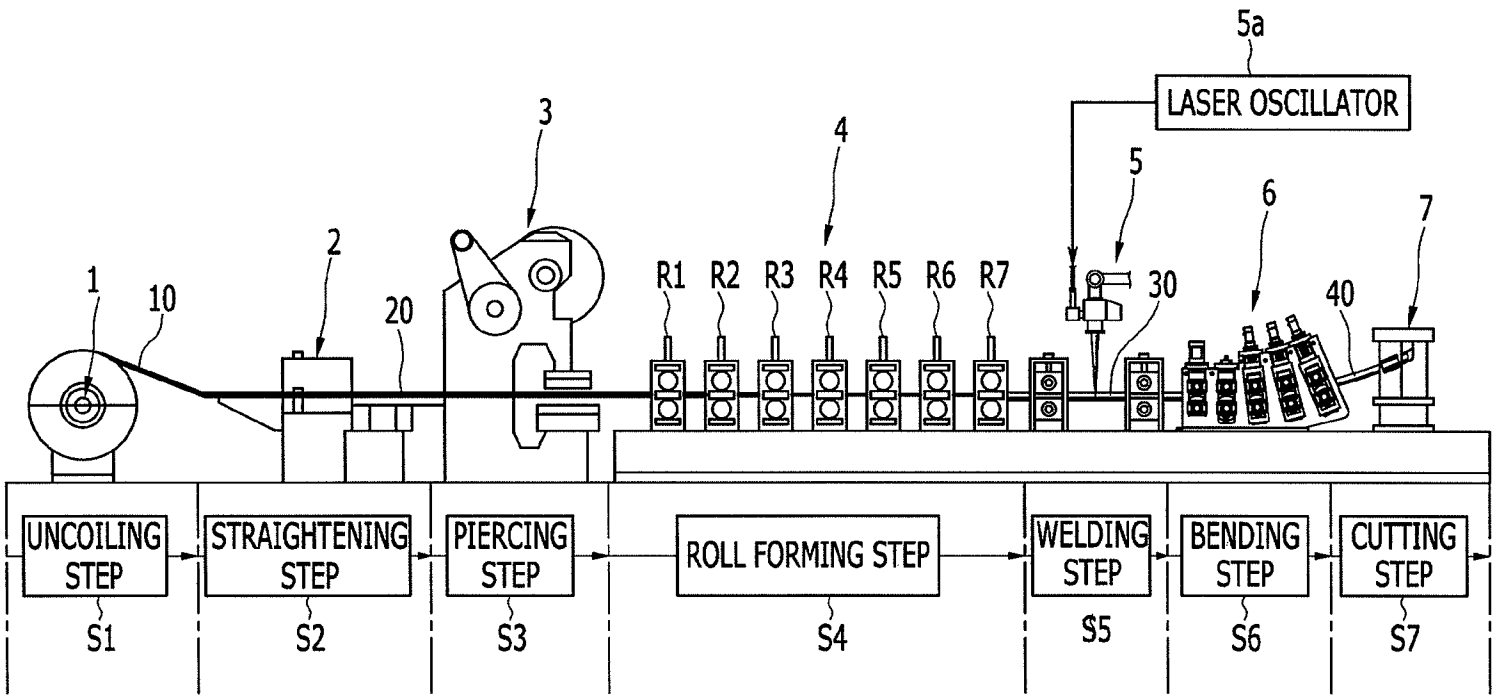
FIG. 1 is a schematic diagram of a typical roll forming system and steps of a roll forming method.

| | |
|---|---|
| 1: uncoiler | 2: straightener |
| 3: brake press | 4: roll forming unit |
| 5: laser welding device | 6: round bender |
| 7: cutting press | |
| BR1, BR2, BR3, BR4, BR5: bending roll units | |
| D: dent | I: concave surface |
| F: outer side surface | 41: lower forming roll |
| 42: upper forming roll | 61: first lower bending roll |
| 62: first upper bending roll | 63: second lower bending roll |
| 64: second upper bending roll | |
| 65: third, fourth, and fifth lower bending rolls | |
| 66: third, fourth, and fifth upper bending rolls | |
| 42a, 62a, 64a: concave surface forming portion | |
| 42b, 62b, 64b: slanted surface forming portion | |

DETAILED DESCRIPTION OF THE EMBODIMENTS

Exemplary embodiments of the present invention will be described in detail with reference to the accompanying drawings.

Size and thickness of components shown in the drawings may be differ from real size and real thickness of the components for better comprehension and ease of description, and thicknesses of some portions and regions are drawn with enlarged scale.

In addition, description of components which are not necessary for explaining the present invention will be omitted, and the same constituent elements are denoted by the same reference numerals in this specification.

Figure 2:
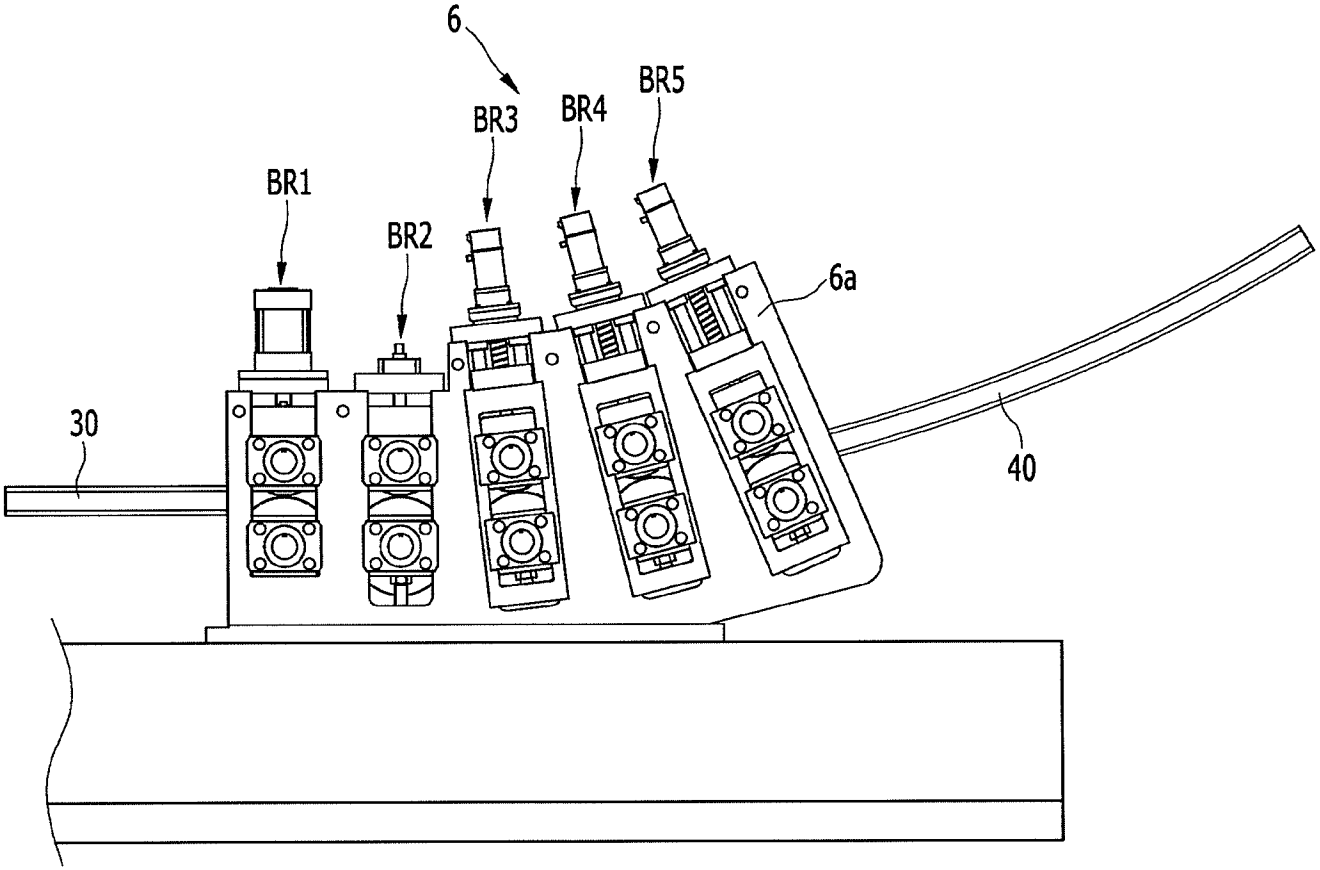
FIG. 2 is a side view of a typical round bender.
Figure 3:
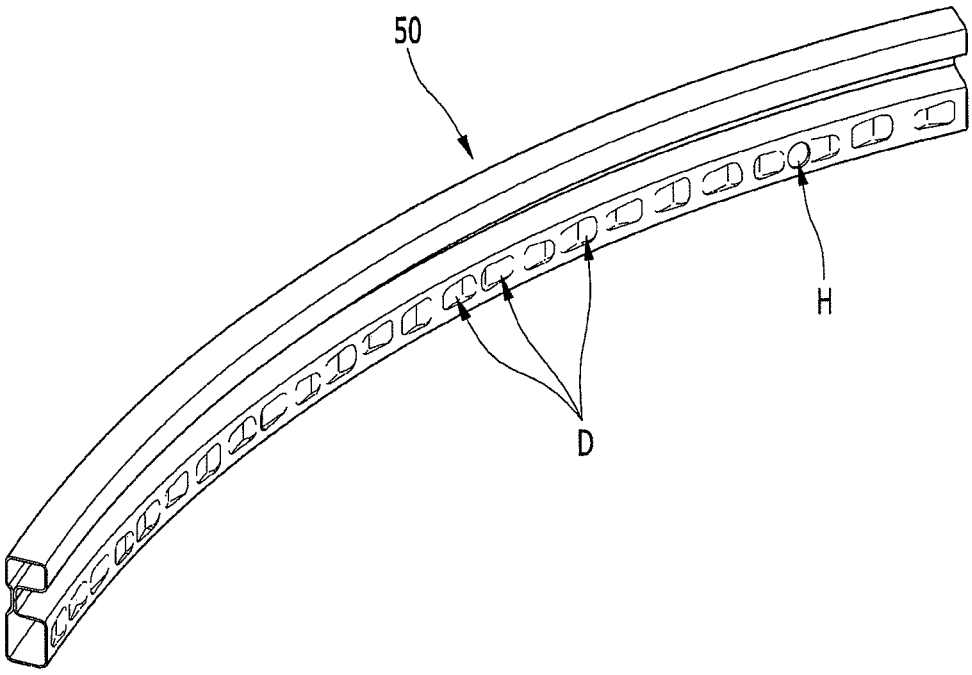
FIG. 3 is a perspective view of a shaped beam produced by a typical roll forming system and a method thereof.
Figure 4:
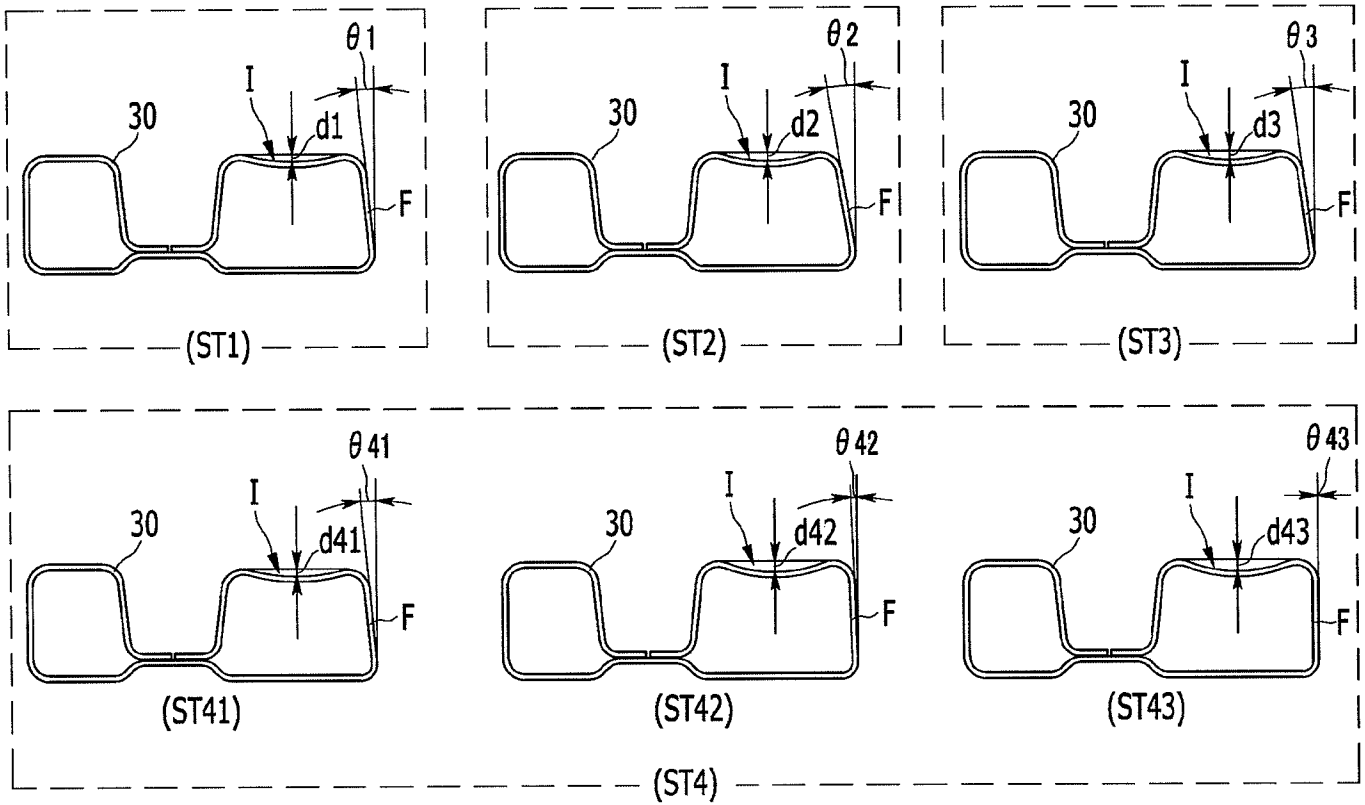
FIG. 4 is a cross-sectional view of a shaped beam for explaining each step of a roll forming method according to an exemplary embodiment of the present invention.

FIG. 1 is a schematic diagram of a typical roll forming system and steps of a roll forming method, FIG. 2 is a side view of a typical round bender, and FIG. 4 is a cross-sectional view of a shaped beam for explaining each step of a roll forming method according to an exemplary embodiment of the present invention.

Referring to FIG. 1, a roll forming system to which a roll forming method according to an exemplary embodiment of the present invention is applied includes an uncoiler 1 disposed at a front portion of a process line and performing an uncoil step S1 at which a coil 10 is uncoiled.

After completing the uncoil step S1, a straightening step S2 at which the coil uncoiled from the uncoiler 1 is straightened to a panel 20 of plate shape through a straightener 2 is performed.

After completing the straightening step S2, a piercing step S3 at which a plurality of holes for assembling is bored at the panel 20 supplied from the straightener 2 is performed.

After completing the piercing step S3, a roll forming step S4 at which the panel 20 supplied from the brake press 3 is sequentially bent to roll form the shaped beam 30 having a closed section through a roll forming unit 4 including at least seven roll formers R1-R7 is performed.

After completing the roll forming step S4, a welding step S5 at which a laser beam from a laser oscillator 5*a* is irradiated to a welding portion of the shaped beam 30 having the closed section supplied from the roll forming unit 4.

After that, a bending step S6 is performed by a round bender 6 disposed at the rear of the laser welding device 5 in the process line. The round bender 6 includes a plurality of bending roll units BR1, BR2, BR3, BR4, and BR5 disposed along the curvature radius and forms the shaped beam 30 having the closed section to have the curvature.

Referring to FIG. 2, the round bender 6 includes the plurality of bending roll units BR1, BR2, BR3, BR4, and BR5.

A first bending roll unit BR1 includes a pair of bending rolls and is disposed at a front portion of a roll frame 6*a* in the process line. The first bending roll unit BR1 guides the shaped beam 30 passing through the welding step S5.

A second bending roll unit BR2 includes a pair of bending rolls and is disposed at the rear of the first bending roll unit BR1 on the roll frame 6*a*. The second bending roll unit BR2 rolling-supports the shaped beam 30 along the curvature direction.

In addition, third, fourth, and fifth bending roll units BR3, BR4, and BR5 respectively include a pair of bending rolls, and are sequentially disposed at the rear of the second bending roll unit BR2 on the roll frame 6*a* along the curvature. The shaped beam 30 passes through the third, fourth, and fifth bending roll units BR3, BR4, and BR5 sequentially such that the shaped beam 40 having the curvature is formed.

After completing the bending step S6, a cutting step S7 at which the shaped beam 40 is cut in a size of the finished product by a cutting press 7 is performed.

A roll forming method according to an exemplary embodiment of the present invention shown in FIG. 4 to FIG. 8 is performed between the roll forming step S4 and the bending step S6.

After a concave surface is formed at a surface of the shaped beam 30 sequentially bent so as to have the closed section at the roll forming step S4, the concave surface of the shaped beam 30 is disposed so as to face toward an inward of the curvature of the shaped beam 30 in the round bender 6 and the shaped beam 30 is formed to have the curvature at the bending step S6 in a roll forming method according to an exemplary embodiment of the present invention.

Referring to FIG. 4 to FIG. 8, a roll forming method according to an exemplary embodiment of the present invention will hereinafter be described in detail.

Referring to FIG. 4, a roll forming method according to an exemplary embodiment of the present invention includes four steps ST1, ST2, ST3, and ST4.

A first step ST1 is performed by the rearmost roll former R7 of the roll forming unit 4 at the roll forming step S4.

In order to prevent occurrence of dents D at the surface of the shaped beam 30 facing toward the inward of the curvature due to heel tap when the shaped beam 30 having the closed section is formed to have the curvature by the round bender 6, the concave surface I for leading the heel tap toward an inward cross-section of the shaped beam 30 is formed in advance at the first step ST1.

It is exemplified in this specification but is not limited that formation of the concave surface I at the first step ST1 is performed by the rearmost roll former R7 at the roll forming step S4. That is, the concave surface I can be formed at an additional forming step or by the first bending roll unit BR1 of the bending step S6 regardless of the roll forming step S4.

When the concave surface I is formed at the first step ST1, an outer side surface F adjacent to the concave surface I is formed slantedly toward the concave surface I by a predetermined angle in order to prevent occurrence of non-uniform deformation at neighboring side surface due to the concave surface I.

Figure 5:
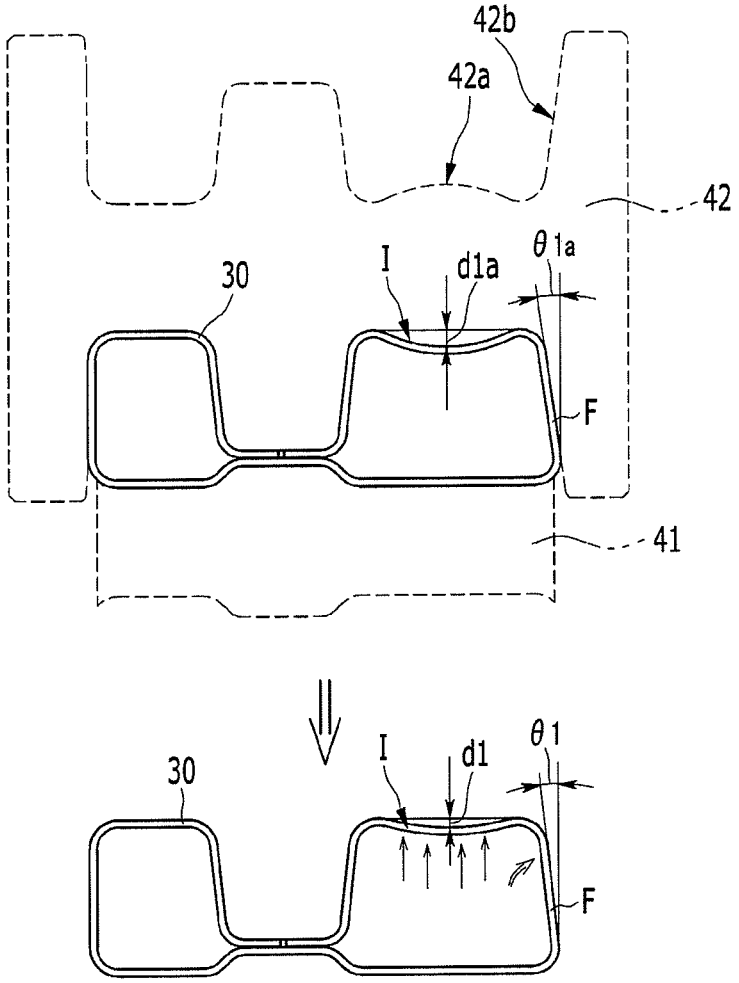
FIG. 5 is a schematic diagram for explaining the first step of a roll forming method according to an exemplary embodiment of the present invention.

Referring to FIG. 5, formation of the concave surface I at the first step will be described in detail.

As shown in FIG. 5, the lower forming roll 41 of the rearmost roll former R7 has the same size and shape as a lower surface of the shaped beam 30.

In addition, a concave surface forming portion 42*a* is formed at an upper forming roll 42 so as to form the concave surface I at a portion of an upper surface of the shaped beam 30 (i.e., an upper surface of the closed section having wider width).

In addition, a slanted surface forming portion 42*b* connected to the concave surface forming portion 42*a* is formed at the upper forming roll 42 so as to form the outer side surface F adjacent to the concave surface I of the shaped beam 30 as a slanted surface.

The concave surface forming portion 42*a* is shaped as a curved surface having a predetermined curvature so as to form the concave surface I having a maximum depth d1*a* of 3.7 mm, and the slanted surface forming portion 42*b* is shaped such that a slanted angle θ1*a* between a vertical line and the outer side surface F is 8°.

Shape and size of the upper forming roll 42 are not limited to these and can be controlled as occasion demands.

After the concave surface I and the neighboring outer side surface F of the shaped beam 30 are formed by the concave surface forming portion 42*a* and the slanted surface forming portion 42*b* of the upper forming roll 42, the maximum depth d1 of the concave surface I is restored to 2 mm and the slanted angle θ1 of the outer side surface F to the vertical line is restored to 6° due to spring back by structural resistance of the closed section.

In addition, a second step ST2 is performed by the first bending roll unit BR1 of the round bender 6 at the bending step S6.

The concave surface I formed at the surface of the shaped beam 30 facing toward the inward of the curvature by the rearmost roll former R7 at the first step ST1 is additionally formed such that the depth of the concave surface I is to be a maximum allowable depth d2*a* at the second step ST2.

It is exemplified in this specification but is not limited that formation of the concave surface I to be the maximum allowable depth d2*a* at the second step ST2 is performed by the first bending roll unit BR1 of the round bender 6 at the bending step S6. That is, the second step ST2 can be performed at an additional forming step regardless of the roll forming step S4 or the bending step S6.

Herein, the maximum allowable depth d2*a* is defined as the maximum depth of the concave surface I where breakage of a formed portion does not occur by forming the concave surface I at the shaped beam 30.

At the second step ST2, the outer side surface F neighboring the concave surface I is formed to be slanted further toward the concave surface I in order to prevent occurrence of non-uniform deformation at the neighboring side surface due to the concave surface I.

Figure 6:
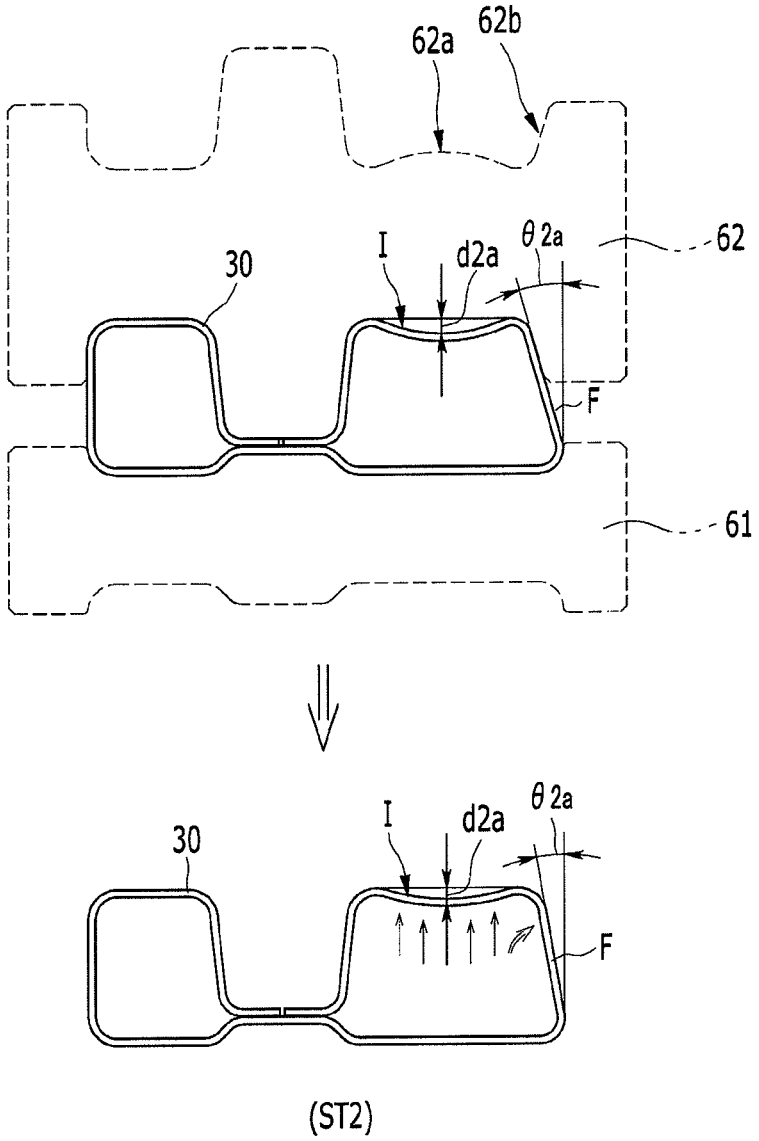
FIG. 6 is a schematic diagram for explaining the second step of a roll forming method according to an exemplary embodiment of the present invention.

Referring to FIG. 6, an additional formation of the concave surface I at the second step ST2 will be described in detail.

As shown in FIG. 6, the first lower bending roll 61 of the first bending roll unit BR1 has the same size and shape as the lower surface of the shaped beam 30.

In addition, a concave surface forming portion 62*a* is formed at the first upper bending roll 62 just like the upper forming roll 42 so as to additionally form the concave surface I at the portion of the upper surface of the shaped beam 30 (i.e., an upper surface of the closed section having wider width).

In addition, a slanted surface forming portion 62*b* connected to the concave surface forming portion 62*a* is formed at the first upper bending roll 62 so as to form the outer side surface F adjacent to the concave surface I of the shaped beam 30 as the slanted surface.

The concave surface forming portion 62*a* of the first upper bending roll 62 is shaped as a curved surface having a predetermined curvature so as to form the concave surface I having the maximum allowable depth d2*a* of 3.7 mm, and the slanted surface forming portion 62*b* is shaped such that a slanted angle θ2*a* between the vertical line and the outer side surface F is 16°.

Shape and size of the first upper bending roll 62 are not limited to these and can be controlled as occasion demands.

After the concave surface I and the neighboring outer side surface F of the shaped beam 30 are formed by the concave surface forming portion 62*a* and the slanted surface forming portion 62*b* of the first upper bending roll 62, the maximum depth d2 of the concave surface I is restored to 3 mm and the slanted angle θ2 of the outer side surface F to the vertical line is restored to 10° due to the spring back by structural resistance of the closed section.

After completing the second step ST2, a third step ST3 is performed by the second bending roll unit BR2 of the round bender 6 at the bending step S6.

The concave surface I additionally formed to have the maximum allowable depth d2*a* by the first bending roll unit BR1 is formed a depth shallower than the maximum allowable depth d2*a* so as to absorb residual stress of the formed portion and lead plastic deformation at the third step ST3.

It is exemplified in this specification but is not limited that leading plastic deformation of the concave surface I at the third step ST3 is performed by the second bending roll unit BR2 of the round bender 6 at the bending step S6. That is, the third step ST3 can be performed at an additional forming step regardless of the roll forming step S4 or the bending step S6.

At the third step ST3, the outer side surface F neighboring the concave surface I is formed to be slanted further toward the concave surface I in order to prevent occurrence of non-uniform deformation at the neighboring side surface due to the concave surface I.

Figure 7:
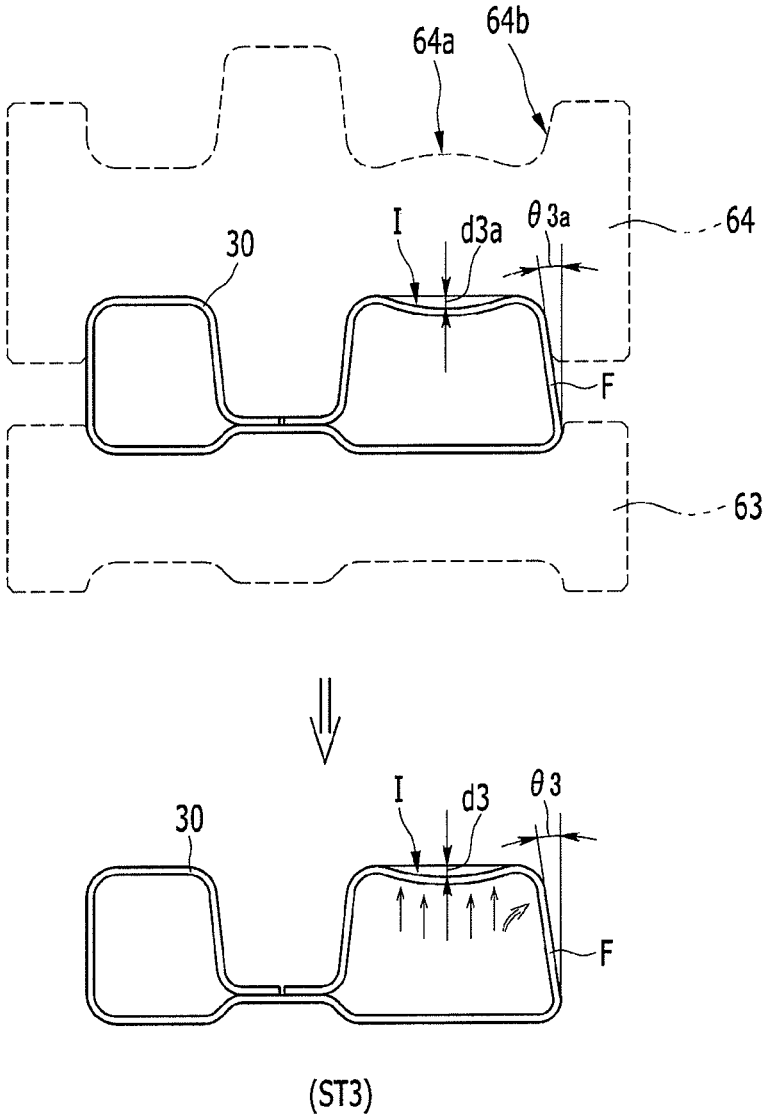
FIG. 7 is a schematic diagram for explaining the third step of a roll forming method according to an exemplary embodiment of the present invention.

Referring to FIG. 7, formation of the concave surface I at the third step ST3 will be described in detail.

As shown in FIG. 7, the second lower bending roll 63 of the second bending roll unit BR2 has the same size and shape as the lower surface of the shaped beam 30.

In addition, a concave surface forming portion 64*a* is formed at the second upper bending roll 64 just like the upper forming roll 42 so as to form the concave surface I at the portion of the upper surface of the shaped beam 30 (i.e., an upper surface of the closed section having wider width).

In addition, a slanted surface forming portion 64*b* connected to the concave surface forming portion 64*a* is formed at the second upper bending roll 64 so as to form the outer side surface F adjacent to the concave surface I of the shaped beam 30 as the slanted surface.

The concave surface forming portion 64*a* of the second upper bending roll 64 is shaped as a curved surface having a predetermined curvature so as to form the concave surface I having the maximum depth d3*a* of 2.4 mm that is smaller than 3 mm being the maximum depth d2 of the concave surface I restored after the second step ST2 is completed by the first upper bending roll 62.

In addition, the slanted surface forming portion 64*b* is shaped such that a slanted angle θ3*a* is 8° that is smaller than 10° being the slanted angle θ2 of the outer side surface F restored after the second step ST2 is completed by the first upper bending roll 62.

Shape and size of the second upper bending roll 64 are not limited to these and can be controlled as occasion demands.

After the concave surface I and the neighboring outer side surface F of the shaped beam 30 are formed by the concave surface forming portion 64*a* and the slanted surface forming portion 64*b* of the second upper bending roll 64, residual stress remained at the concave surface I that is formed to the maximum allowable depth d2*a* at the second step ST2 and the outer side surface F is absorbed, and plastic deformation is led. Through the plastic deformation, the maximum depth d3 of the concave surface I is maintained to be 3 mm and the slanted angle θ3 of the outer side surface F to the vertical line is about 8°.

The fourth step ST4 is performed by the third and fourth and the fifth bending roll units BR3, BR4, and BR5 of the round bender 6 at the bending step S6.

After the concave surface I of the shaped beam 30 is disposed so as to face toward the inward of the curvature, the shaped beam 30 is formed to have the curvature through three steps at the fourth step ST4.

Figure 8:
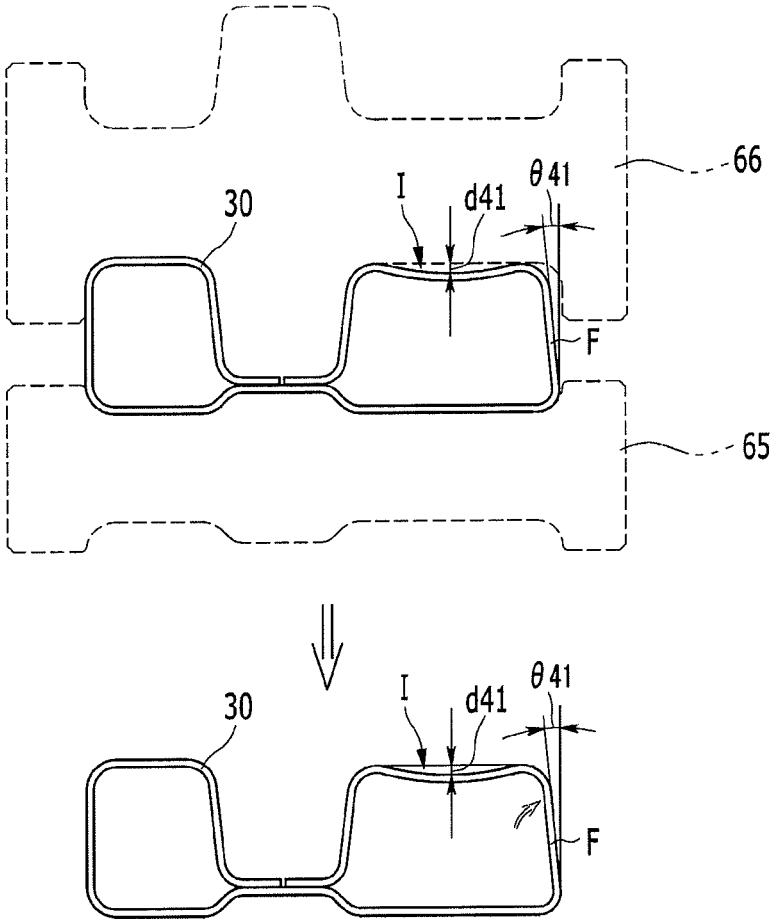
FIG. 8 is a schematic diagram for explaining the fourth step of a roll forming method according to an exemplary embodiment of the present invention.

Referring to FIG. 8, deformations of the concave surface I and the slanted outer side surface F, when the shaped beam 30 is formed to have the curvature through the three steps at the fourth step ST4, will be described in detail.

As shown in FIG. 8, the third, fourth, and fifth lower bending rolls 65 of the third, fourth, and fifth bending roll units BR3, BR4, and BR5 have the same size and shapes as the lower surface of the shaped beam 30.

In addition, the concave surface forming portion 42*a* and the slanted surface forming portion 42*b* for forming the concave surface I and the slanted outer side surface F are not formed at the third, fourth, and fifth upper bending rolls 66.

Accordingly, when the curvature is formed at the shaped beam 30 passing through the third, fourth, and fifth upper bending rolls 65, the heel tap occurring at the surface of the shaped beam 30 facing toward the inward of the curvature is absorbed by the concave surface I.

At this time, the stress generated at the concave surface I by the heel tap is delivered to the outer side surface F adjacent to the concave surface I and is absorbed at the outer side surface F as the slanted angle becomes small.

As the shaped beam 30 passes through the third upper bending roll 65, the maximum depth d41 of the concave surface I is increased to 3.2 mm and the slanted angle θ41 of the outer side surface F is reduced to 5° at the step ST41.

As the shaped beam 30 passes through the fourth upper bending roll 65, the maximum depth d42 of the concave surface I is increased to 3.4 mm and the slanted angle θ42 of the outer side surface F is reduced to 2° at the step ST42.

As the shaped beam 30 passes through the fifth upper bending roll 65, the maximum depth d43 of the concave surface I is maintained to 3.4 mm but the slanted angle θ43 of the outer side surface F is reduced to 0° at the step ST43.

As described above, after the concave surface I is formed at the surface of the shaped beam 30 sequentially bent to have at least one of closed section by the plurality of roll formers R1-R7 at the roll forming step S4, the stress generated at the inward surface of the curvature of the shaped beam 30 by the heel tap is absorbed by the concave surface I at the bending step S6 according to an exemplary embodiment of the present invention. Therefore, occurrence of the dent D is prevented.

When the concave surface I is formed at the inward surface of the curvature of the shaped beam 30, the outer side surface F adjacent to the concave surface I is formed as the slanted surface so as to absorb irregular deformation of the neighboring side surface of the concave surface I.

At this time, the outer side surface F is formed to have predetermined slanted angles respectively at the first step ST1, the second step ST2, and the third step ST3.

On the contrary, the slanted angle of the outer side surface F is not regulated at the fourth step ST4 so as to absorb the stress generated at the concave surface I by the heel tap when the shaped beam 30 is formed to have the curvature.

Figure 9:
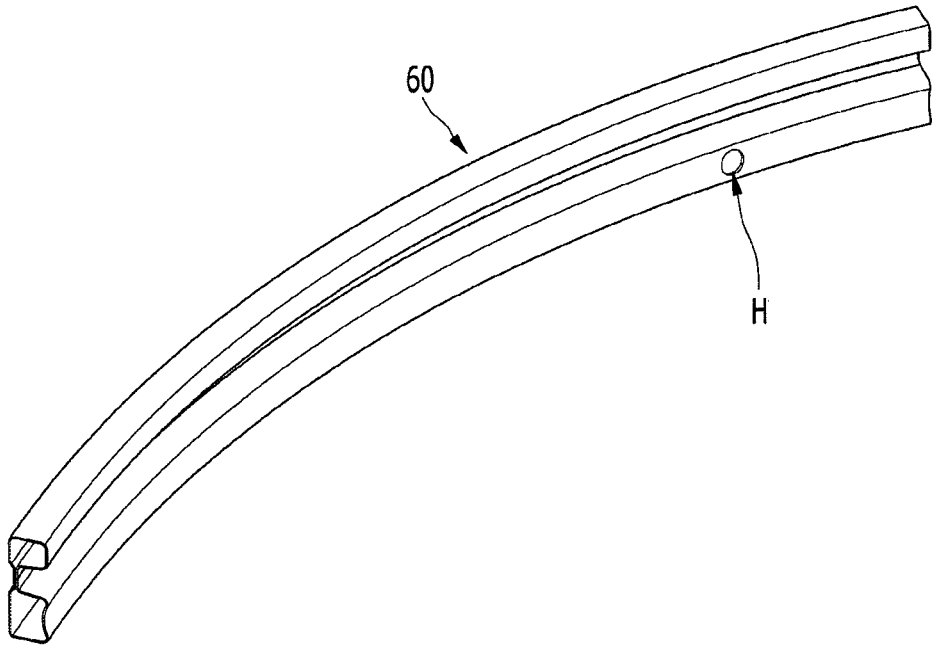
FIG. 9 is a perspective view of a shaped beam produced by using a roll forming method according to an exemplary embodiment of the present invention.

The shaped beam 40 formed to have the curvature by the roll forming method is formed to have two closed section, and is produced to be a bumper beam 60 for a vehicle shown in FIG. 9 through the cutting step S7.

The shaped beam produced by the roll forming method prevents deterioration of impact strength as a consequence of preventing occurrence of the dents at the lower closed section due to the heel tap as shown in FIG. 9.

In a case that the shaped beam according to an exemplary embodiment of the present invention is applied to the bumper beam 60 for the vehicle, curved surface is not formed around inner and outer holes H to which the towing hook pipe (not shown) is assembled. Therefore, towing hook pipe (not shown) can be easily welded.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A roll forming method comprising:

receiving a panel at a plurality of roll formers;

sequentially forming, via the plurality of roll formers comprising forming portions, the panel into a shaped beam having at least one closed section by forming a concave surface having a first depth, as formed without breakage, at a surface of a shaped beam;

forming a slanted surface having a slanted angle connected to the concave surface;

forming the concave surface to have a second depth shallower than the first depth; and restoring the first depth of the concave surface and the slanted angle of the slanted surface in response to spring back by resistance of the closed section; and sequentially bending, via a round bender comprising a plurality of bending roll units, the shaped beam to have a curvature, wherein the concave surface is formed at a surface of a shaped beam having the closed section at the roll forming step, the concave surface is disposed so as to face toward an inward of a curvature of the shaped beam in the round bender, and the shaped beam is formed to have the curvature through multiple steps such that the concave portion has the first depth at the bending step.

2. The roll forming method of claim 1, wherein formation of the concave surface begins at a rearmost roll former of the plurality of roll formers.

3. The roll forming method of claim 1, wherein formation of the shaped beam to have the curvature is performed by at least three bending roll units provided in the round bender.

4. The roll forming method of claim 1, wherein the slanted side surface of the shaped beam includes an outer side surface adjacent to the concave surface, and the outer side surface is slanted toward the concave surface so as to have the slanted angle.

5. The roll forming method of claim 4, wherein the slanted angle of the outer side surface is controlled at the roll forming step but is not controlled at the bending step.

6. The roll forming method of claim 1, wherein the concave surface is formed as a predetermined curvature.

7. The shaped beam produced by using the roll forming method of claim 1.

8. A roll forming method comprising a roll forming step where a shaped beam having at least one closed section is roll-formed by sequentially bending a panel through a roll forming unit provided with a plurality of roll formers, and a bending step where the shaped beam is formed so as to have a curvature through a round bender provided with a plurality of bending roll units, the roll forming method further comprising:

a first step where a concave surface is formed, via the plurality of roll formers comprising forming portions, at a surface of the shaped beam facing toward an inward of the curvature;

a second step where the concave surface is formed, via the plurality of roll formers comprising the forming portions, to have a first depth, as formed without breakage, at a surface of the shaped beam;

a third step where the concave surface is formed, via the plurality of roll formers comprising the forming portions, to have a second depth shallower than first depth such that residual stress of a formed portion is absorbed and plastic deformation is led;

a fourth step where a slanted surface is formed, via the plurality of roll formers comprising the forming portions, having a slanted angle connected to the concave surface; and a fifth step where the concave surface of the shaped beam is disposed so as to face toward the inward of the curvature such that heel tap due to formation of the curvature is absorbed, and the shaped beam is formed to have the curvature through multiple steps.

9. The roll forming method of claim 8, wherein the first step is performed by a rearmost roll former of the roll forming unit.

10. The roll forming method of claim 8, wherein the second step to the fifth step are performed by bending roll units of the round bender.

11. The roll forming method of claim 8, wherein the slanted side surface of the shaped beam includes an outer side surface adjacent to the concave surface, and the outer side surface is formed to have a respective predetermined slanted angle at each step.

12. The roll forming method of claim 11, wherein the respective predetermined slanted angle of the outer side surface is respectively controlled at the first step, the second step, and the third step.

13. The roll forming method of claim 11, wherein the respective predetermined slanted angle of the outer side surface is not controlled at the fourth step such that a stress due to heel tap toward the concave surface occurring at formation of the curvature of the shaped beam is absorbed.

14. The roll forming method of claim 8, wherein the fifth step is performed through at least three bending roll units.

* * * * *